US007082887B2

(12) United States Patent
Fuller

(10) Patent No.: US 7,082,887 B2
(45) Date of Patent: Aug. 1, 2006

(54) STABILIZING APPARATUS FOR WATERCRAFT

(76) Inventor: Ross Anthony Fuller, 51 Rototuna Road, Flagstaff, Hamilton 2001 (NZ)

( * ) Notice: Subject to any disclaimer, the term of this patent is extended or adjusted under 35 U.S.C. 154(b) by 0 days.

(21) Appl. No.: 10/275,991

(22) PCT Filed: May 8, 2001

(86) PCT No.: PCT/NZ01/00076

§ 371 (c)(1),
(2), (4) Date: May 28, 2003

(87) PCT Pub. No.: WO01/85536

PCT Pub. Date: Nov. 15, 2001

(65) Prior Publication Data

US 2003/0200908 A1 Oct. 30, 2003

(30) Foreign Application Priority Data

May 8, 2000 (NZ) ..... 504403

(51) Int. Cl.
*B63B 43/14* (2006.01)

(52) U.S. Cl. ..... 114/123; 114/283; 114/292

(58) Field of Classification Search ..... 114/123, 114/283, 292, 360
See application file for complete search history.

(56) References Cited

U.S. PATENT DOCUMENTS 2,319,132 A 5/1943 Hood
2,794,191 A 6/1957 Gaskouitz
3,063,398 A * 11/1962 Yohe ..... 114/292
3,485,198 A * 12/1969 Matthews ..... 114/123
3,844,241 A 10/1974 Black et al.
4,320,713 A 3/1982 Nishida et al.
4,512,277 A 4/1985 Williams
4,598,659 A 7/1986 Chinnery
5,107,783 A 4/1992 Magazzù
5,529,009 A 6/1996 Faury et al.
5,544,607 A 8/1996 Rorabaugh et al.
5,915,328 A 6/1999 Rowan
5,988,090 A 11/1999 Barker, Jr.

FOREIGN PATENT DOCUMENTS

NL 7512927 5/1997

OTHER PUBLICATIONS

"Dolphin Aqualisers", pages from website http://www.aqualisers.com, 4 pages, printed Jul. 14, 2005.
"Both Aqualisers Latched 'Up' . . . ", four images of Aqualiser of the present invention, undated.

(Continued)

*Primary Examiner*—Sherman Basinger
(74) *Attorney, Agent, or Firm*—Abelman, Frayne & Schwab

(57) ABSTRACT

Stabilizing apparatus have particular application in stabilizing smaller water borne objects such as small dinghies, sail craft, pontoons and aquatic sporting equipment at rest on a body of water, or any aquatic vessel including launches. The stabilizing apparatus includes a body having one or more elongate stabilizing pods including at least one cavity for containing a calculated volume of air. The body is attached to a side and towards the rear of the water borne object, in the region of the plane of the waterline of the object. The stabilizing apparatus operates between a non-use, storage position and an extended operating position and includes latching apparatus to maintain the body in either or both those positions.

26 Claims, 5 Drawing Sheets

OTHER PUBLICATIONS

Class M&I Certificate for "Stability Device" from New Zealand Marine & Industrial Safety Inspection Services Limited, dated Jul. 15, 2002.
New Zealand Department of Conservation letter dated Aug. 29, 2003 for "Dolphin Aqualisers".
Letter from E.A.L. Jones of Hawke's Bay, New Zealand, undated.
Letter from Brain Harris of Vogeltown, New Plymouth, New Zealand, dated Mar. 31, 2001.
Letter of Neville Freeman of Glenfield, Auckland, New Zealand, undated.
Subject: "Aqualisers", E-mail from Lindsay Smith, dated Jan. 12, 2003.
Letter of John Pitcher of Surfers Paradise, Queensland, Australia, dated Dec. 6, 2002.
E-mail from Anthony Byrne, dated Dec. 18, 2002.
Letter from Chad Hall, Better Boating, Western Australia, Australia, dated Nov. 2, 2002.
Letter from Leon Beurteaux, Perth, Western Australia, Australia, dated Nov. 29, 2002.
Subject: "RE: Aqualiser", E-mail from Leigh Mair, Vancouver, Canada, dated May 2, 2004.
Subject: "The Dolphin Aqualisers Maiden Voyage in Canada", E-mail from Gerry Bridge, Toronto, Canada, dated Mar. 26, 2003.

* cited by examiner

STABILIZING APPARATUS FOR WATERCRAFT

TECHNICAL FIELD

This invention relates to improvements in and relating to stabilising apparatus.

The stabilising apparatus will have particular use in operating as a stabilising and/or a flotation device for objects at rest on a body of water.

In particular, it is envisaged the stabilising apparatus will have particular application in relation to aquatic vehicles, such as boats and particularly the smaller dinghy or sail craft. However, the stabilising apparatus may also be used with the range of aquatic sporting equipment, or other objects where it is preferable for the object to be stable when at rest on water.

It should also be appreciated that the stabilising apparatus may have applications outside this field.

BACKGROUND ART

In the prior art there are a number of inventions directed to stabilising ships and other water borne vessels and/or equipment used on water.

Such inventions may be directed to hydrodynamic or hydrostatic features of hulls or hydrofoils, and may include equipment to decrease pitch or roll or unwanted vessel movement. The inventions may be directed to self-righting, collapsible and unsinkable systems. They may be directed to the particular design and construction of a floating hull. They may include such equipment as hydroplane blades or outriggers designed to improve both the stability of the vessel or object on the water or improve the flotation of the vessel or object.

Such equipment may be designed specifically to improve the stability and flotation of a vessel or object in motion, whilst others may be particularly designed to improve the stability and flotation of vessels or objects at rest on a body of water.

For example, a boat hull may be specifically designed to provide a space under the deck between the bow stern and bottom of the boat to provide buoyancy for the hull as disclosed in New Zealand Patent No. 302612. Yet other systems may employ the use of floats connected to a central hull in a typical trimaran design as in New Zealand Patent Specification No. 237938 and 241329. In these examples the system in effect becomes multi-hulled, with two side floats positioned on either side of the central float (hull).

The position and operation of such floats may be adjustable as in the above mentioned patent specifications, or may be fixed as a side extending rigid float as described in relation to sail boards in Patent Specification 206254.

In the systems described, the floats are attached above the waterline relative to the main vessel, with the side floats themselves being partially submerged (particularly when the vessel is stationary).

Retractable floats or outrigger stabilisers for aquatic vehicles are described in a number of prior art documents including New Zealand Patent No. 175973 and 149659. In such situations the outrigger stabilisers extend on each side of a vessel from points of attachment adjacent the top of each side of the vessel.

However, there are problems associated with all of the above systems. In the scenario where a space is provided under the deck of the boat between the bow and stern and bottom to provide buoyancy for the hull, the buoyancy does not necessarily improve the stability of the vessel.

Typically a at rest on a body of water will rock due to the impact of wind, waves and currents. When the vessels are small (such as in the case of small aluminum dinghies or sailboats), the relative buoyancy of the vessel tends to make it more unstable than is the case for larger, heavier vessels. Accordingly, small vessels or other objects tend to rock more vigorously when at rest in most bodies of water.

In systems relying on laterally disposed floats connected to a central hull in a typical trimaran arrangement, the floats are designed to minimise the rolling and rocking motion of the boat and provide additional flotation for the boat. The point of attachment of most of the floats is typically at deck level or attached toward the upper part of the main hull. Where such systems rely on retractable floats, they typically involve complex pivoting assemblies to allow the float to be folded against the hull or raised out of the water (when the float is not required). The overall design of the floats is typically bulky and they are somewhat cumbersome when retracted. Further, the retractable systems typically operate on hydraulic/pneumatic systems requiring suitable pressure to operate them.

Systems that include rigid floats permanently attached to the sides of a vessel (whilst providing some stability to the vessel), can become cumbersome and undesirable when the vessel is being stored, or where the stabilising/flotation apparatus is not required.

Accordingly, it would be advantageous to have a flotation and stabilising system for water borne objects that:

a) assists in decreasing the pitch, rocking, roll, or similar unwanted vessel movement particularly when the vessel or object is at rest on the body of water;
b) is a system where the flotation/stabilising apparatus is available when required and is easily positioned in to its operating position, without the need for hydraulic or powered systems, or can be raised or lowered without the need for hydraulic or powered systems; and
c) is simple to manufacture and cost effective to produce; and
d) can be used with a range of water borne vessels, sporting equipment and objects, particularly smaller vessels and the like, as and when required; and
e) is easy to attach to a vessel, sporting equipment or object by any home handy person, or can be an optional extra for a range of vessels sold with or as an attachment to said vessels; and
f) is a compact system which in its non-operating position is not bulky, nor gets in the way.

It is an object of the present invention to at least address the foregoing problems and/or provide the public with a useful choice.

Further aspects and advantages of the present invention will become apparent from the ensuing description that is given by way of example only.

SUMMARY OF INVENTION

According to one aspect of the present invention there is provided stabilising apparatus for use in stabilising stationary, water borne objects, said stabilising apparatus including a body said body capable of pivoting between a non-use, storage position to an extended, operating position, said stabilising apparatus also including latching apparatus capable of maintaining the body in either or both the extended operating position or the non-use storage position, and characterised in that the body of the stabilising apparatus is attached to the water borne object in the region of the plane the waterline of the vessel.

According to another aspect of the present invention there is provided an stabilising apparatus substantially as described above wherein the body of the stabilising apparatus when in a non-use storage position is aligned in a substantially parallel arrangement to the linear axis of the object, and when in an extended operating position extends from the object in a substantially perpendicular arrangement relative to the linear axis of the object.

In accordance with another aspect of the present invention there is provided stabilising apparatus substantially as described above wherein the stabilising apparatus is laterally disposed relative to the body of the water borne object when the stabilising apparatus is in the extended operating position.

According to another aspect of the present invention there is provided stabilising apparatus substantially as described above wherein the stabilising apparatus is folded against the sides of the water borne object when the stabilising apparatus is in the non-operating position.

According to another aspect of the present invention there is provided stabilising apparatus substantially as described above wherein the point of attachment of the stabilising apparatus to the side(s) of the water borne object is displaced towards the stern or back of the object.

According to another aspect of the present invention there is provided stabilising apparatus substantially as described above wherein the latching apparatus includes an outrigger arm capable of locking the stabilising apparatus in the extended operating position.

According to another aspect of the present invention there is provided stabilising apparatus substantially as described above wherein the body of the stabilising apparatus includes at least one internal cavity.

According to another aspect of the present invention there is provided stabilising apparatus substantially as described above wherein the body of the stabilising apparatus is dimensioned to extend a preferred distance from the side of the object when in the extended operating position.

According to a further aspect of the present invention there is a method of manufacturing stabilising apparatus for use in stabilising stationary water borne objects, said stabilising apparatus including a body said body capable of pivoting between a non-use, storage position to an extended, operating position, said stabilising apparatus also including latching apparatus capable of maintaining the body in either or both the extended operating position or the non-use storage position, and characterised in that the body of the stabilising apparatus is attached to the water borne object in the region of the plane the waterline of the vessel.

According to a further aspect of the present invention there is a method of hingedly attaching stabilising apparatus for use in stabilising stationary water borne objects to said object, said stabilising apparatus including a body said body capable of pivoting between a non-use, storage position to an extended, operating position, said stabilising apparatus also including latching apparatus capable of maintaining the body in either or both the extended operating position or the non-use storage position, and characterised in that the body of the stabilising apparatus is attached to the water borne object in the region of the plane the waterline of the vessel.

For the purpose of this specification, the point of attachment of the body to the side(s) of the object is in the region of the plane of the waterline when the object is floating on the water, and this term also includes the chine line (being the join between the side and the bottom of a vessel).

In preferred embodiments of the present invention, the stabilising apparatus is designed to eliminate the instability of water borne vessels and/or sporting equipment at rest on a body of water. In effect, the stabilising apparatus operates as a flotation device. However, the stabilising effect is determined by:

a) the dimensions of the stabilising apparatus,
b) its point of attachment in terms of its vertical positioning on the vessel or sporting equipment,
c) its position of attachment along the side(s) of the vessel or sporting equipment,
d) the distance it extends from the vessel or object when in the extended operating position, and
e) the volume of air contained in the cavity(s) of the body.

This is particularly relevant for smaller vessels such as aluminium boats, small sailboats, smaller aquatic sporting equipment, floating pontoons/docks and so forth, where there is a tendency for the object to rock vigorously when at rest on most large bodies of water. Wind and water movements per se contribute to the rocking and rolling characteristics of an object at rest on a body of water. The stabilising apparatus, when fitted, is designed to reduce or substantially eliminate the tendency of the object to rock. As can be appreciated variations to the stabilising apparatus may be used in other situations where objects are at rest on fluid surfaces.

As the stabilising apparatus is designed for use when the object is at rest, the stabilising apparatus preferably is able to operate between an extended operating position and a retracted, non-use or storage position. Accordingly, when the body of the stabilising apparatus is in the non-use position, it is substantially aligned in a parallel arrangement to the linear axis of the object to which it is attached.

Conversely, when the stabilising apparatus is in an operating position, it extends from an object in a substantially perpendicular arrangement to the linear axis of the body.

To allow the body of the stabilising apparatus to operate between the operating and non-operating positions, the stabilising apparatus is preferably hinged to a portion of the side(s) of the object. The hinging system enables the stabilising apparatus to pivot through an arc of up to, or more than 90°.

The hinging apparatus is preferably attached to one side of the body of the stabilising apparatus and is configured to receive complementarily configured portions of the hinging apparatus also attached to the side of the object. The vertical positioning of the hinging apparatus in respect of the depth of the side of the object, is preferably at a position equating to the chine line on a vessel, or substantially equating to the plane of the waterline when the object is floating in the water.

Accordingly, in operation the body of the stabilising apparatus pivots down from the non-use position (against the side of the object) to rest on the water (only partially submerged therein) when in the extended position.

The hinging system preferably comprises at least two of either or both hinge eyes and hinge pins attached to the side of the vessel in the appropriate position which interact and engage with complementarily configured hinge eyes and hinge pins on the side of the body of the stabilising apparatus. Locking pins may be employed to maintain the body in contact with the hinge components on the object, or the hinge pins may include end caps that fit over the hinge pins and prevent them sliding out of the complementary hinge eye with which they are engaged. It can however, be appreciated any suitable hinging system may be employed for use with this invention.

Given the stabilising apparatus is being used on water it is preferable that the componentry of the hinging system be resistant to the effects of water and particularly salt water. Accordingly, the hinging system may be manufactured from plastic materials, or suitable metals (including stainless steel).

The body of the stabilising apparatus is preferably substantially rectangular in overall configuration. In preferred embodiments, and where the stabilising apparatus is to be used in conjunction with aluminium vessels from 8 foot up to 14 ft 6", the length of the body is approximately 1.5 m long with a width of approximately of 350 mm. The depth of the stabilising apparatus may vary provided the body of the stabilising apparatus does not become too cumbersome, nor extends too far from the side of the object when stored in the non-use position.

The body is preferably hollow for at least a portion of its length. The cavity(s) created within the body essentially contains air which contribute to the flotation characteristics of the body. The volume of air contained therein also contributes to the ability of the stabilising apparatus to stabilise the vessel.

As can be appreciated, in some embodiments the cavity may extend the full length and internal width of the body, or may be compartmentalised. Alternatively, the body may be made of materials that in their production include natural cavities inherent in the structure of the material. For example, some foamed plastic materials, polystyrenes and so forth may be used in the manufacture of the body of the stabilising apparatus. The particular materials used will thereby influence the dimensions of any cavity(s) within the body.

As mentioned previously, in operation the body of the stabilising apparatus pivots downward to the extended operating position when the stabilising apparatus is in use. However, it can be appreciated once in the extended operating position, there is a requirement to maintain the body in that position to effect the required stabilising effect of the stabilising apparatus. Accordingly, the stabilising apparatus includes latching apparatus.

When the body of the stabilising apparatus is extended, the latching apparatus may manually or automatically be released to allow the body of the stabilising apparatus to either pivot down (or be lowered down) onto the surface of the water.

In preferred embodiment of the present invention, the latching apparatus includes a bracing arm in the form of an outrigger arm. The outrigger arm may be fixedly attached either or both to the side of the vessel and to the body of the stabilising apparatus. The latching apparatus may also include separate clasping apparatus attached to either or both the object and the body of the stabilising apparatus.

When attached to the side of the object the attachment point of the latching apparatus is preferably in a position equating approximately to the upper position/line where the body of the stabilising apparatus would reach when pivoted up in the non-use storage position. In some embodiments the outrigger arm attachment in that position may also be configured to interact with and latch the body of the stabilising apparatus against the side of the object in the non-use storage position.

The opposite, outer distal end of the outrigger arm may either be attached to the body, or may be free (unconnected). When the distal end of the outrigger arm is attached to the body, the latching system may include swivel systems to enable the outrigger arm to be reoriented from a stored alignment to a bracing alignment. In addition, the outrigger arm may either be a predetermined set length, or may include hinged or telescopic sections that can be compressed for storage of the outrigger arm in the non-use position, or extended when the outrigger arm is used to brace the body in the extended position.

In embodiments where the outer distal end of the outrigger arm is free, the end may engage with clasping apparatus on a portion of the body and be essentially locked into position during use of the stabilising apparatus. There are a number of systems available by which the outer distal end of the outrigger arm may engage and lock with a portion of the body. For example, the outrigger arm may be an extended hook having a substantially long body section equating to the length required of the outrigger arm to reach and engage with the body when the body is in the extended position. The complimentary portion on the body may be an eye configured to receive the hook portion. The eye may be attached to the body, or the body may be configured in its design to include a portion that would serve as a receiving eye for the hook.

Alternately, the outer distal end of the outrigger arm may include a bulbous portion that engages with a complementary configured indentation in the upper surface or edge of the body. Pressure may merely hold the outrigger arm in position in the indentation. Yet further systems may be employed such as bayonet fitting, screw threads, push-fit friction systems, and so forth.

With larger water borne objects, dimensions of the object and/or the stabilising apparatus may warrant the operation of the hinge and/or the outrigger arm by pneumatic, hydraulic or similarly powered systems.

When the stabilising apparatus is not in use and is folded against the body of the vessel and/or object to which it is attached, the outrigger arm (that serves to brace the body of the stabilising apparatus in an extended position) may be folded, pivoted or re-aligned to lie alongside the vessel or the object. Alternately, the body of the stabilising apparatus may be configured to include a suitable indentation that complements the shape of the outrigger arm and into which the outrigger arm fits and is maintained when the stabilising apparatus is not in use.

In preferred embodiments of the present invention the body of the stabilising apparatus preferably comprises a single stabilising pod. Where the stabilising apparatus is used with vessels of a size between eight to fourteen and a half feet in length, the dimensions of the preferred single pod are approximately 1.5 m long and up to 350 mm wide, outrigged from the side of the vessel hull by a distance of 100 mm. In such scenario, the device is preferably hinged to either side of a vessel at the chine line, for the first 1.5 m starting from the stern of the vessel.

Any wave motion that would normally rock the vessel or water borne object is dampened and deflected as a result of the designed surface area of the single pod, along with the calculated volume of air contained within the device. However, as can be appreciated, other embodiments of the stabilising apparatus may include a body comprised of two or more stabilising pods arranged in a substantially parallel configuration to each other and having individual dimensions as required to provide a preferred designed surface area for minimising the tendency of a vessel or water borne object to rock in response to wave motion when the vessel/object is at rest on a body of water.

In addition, the contours of the upper and lower surface of the stabilising pod(s) may vary. For example, the stabilising pod may have a substantially flat upper and lower surface.

A substantially flat lower surface ensures maximum contact of the lower surface of the stabiliser pod with the water.

Yet in other embodiments, the upper surface, or the whole, of the stabiliser pod may be configured to be substantially concave in shape when looking at the stabiliser pod from the side. The concave shape may facilitate more compact alignment of the body of the stabilising apparatus against the vessel and/or object when the stabilising apparatus is in its non-use storage position.

Where the stabilising apparatus includes a body comprised of two or more stabilising pods, each pod may be differently configured depending upon its position relative to the point of attachment of the body to the vessel of object. For example, the first stabiliser pod (closest to the point of attachment to the vessel) may be substantially flat, with successive stabilising pods being increasingly concave in shape (having a similar shape or configuration to a surfboard and/or water-ski) so that in the non-use position, the upper portions of the body are most closely aligned to the structure of the vessel or object.

As can also be appreciated, given the overall shape of a vessel or object to which the stabilising apparatus may be attached, the stabilising apparatus may be configured along the edge by which it is attached to the vessel, to confirm to the actual shape of the vessel rather than being strictly linear along that edge. Accordingly, the inner edge of the stabilising apparatus may be substantially curved to conform to the vessel shape and/or object to which it is attached.

Where the body of the stabilising apparatus comprises of two or more stabilising pods, the pods may be directly attached to each other, or may be distanced from each other by appropriate attachment apparatus that creates gaps between each successive stabilising pod.

To improve the flotation properties of the device the stabilising apparatus is preferably made from thermoplastics materials such as polyvinylchlorine products. A range of thermoplastics material may be used internally, such as polystyrene or other foamed plastic materials which have their own inherent air cavities to improve buoyancy of the body. Alternately, the pods of the body of the stabilising apparatus may be made from other materials, such as fibreglass, wooden products (such as marine plywood) and so forth. Again, buoyant materials such as polystyrene or other foamed plastics materials may be used in conjunction with these materials either externally, or internally as required. In other situations, the stabilising apparatus or components thereof may also be made from stainless steel, aluminium or any other suitable metal capable of withstanding the effects of water and in particular salt water.

In addition, the overall body of the stabilising apparatus may have an external coating of resin or other suitable coating that may or may not be coloured.

It is conceivable also, that the stabilising apparatus may also be used as a means of re-entering the vessel or object in the event that a person has fallen overboard or off the vessel or object. In such a scenario, the stabilising apparatus would be in its extended operating position and could thereby be used as a boarding device.

A further use of the stabilising apparatus may be as a detachable emergency lifesaver/flotation device in the event of the vessel and/or object capsizing. As such the stabilising apparatus may remain attached to the vessel and/or object, or be quickly and easily detached from the vessel and/or object in order to simply support the person in the water. However, this use of the invention is in no way promoted as a replacement or an alternative to the use of life jackets and so forth as standard safety gear on boats.

As can be appreciated, the above description has been given by way of example only and it should be appreciated that variations and modifications may be made to the stabilising apparatus as required in different situations, with different vessels and/or objects and so forth. Further, the terminology used should not be viewed as limiting the scope of this specification, particularly where broader interpretations are possible.

BRIEF DESCRIPTION OF DRAWINGS

Further aspects of the present invention will become apparent from the following description that is given by way of example only and with reference to the accompanying drawings in which.

BEST MODES FOR CARRYING OUT THE INVENTION

Figure 1:
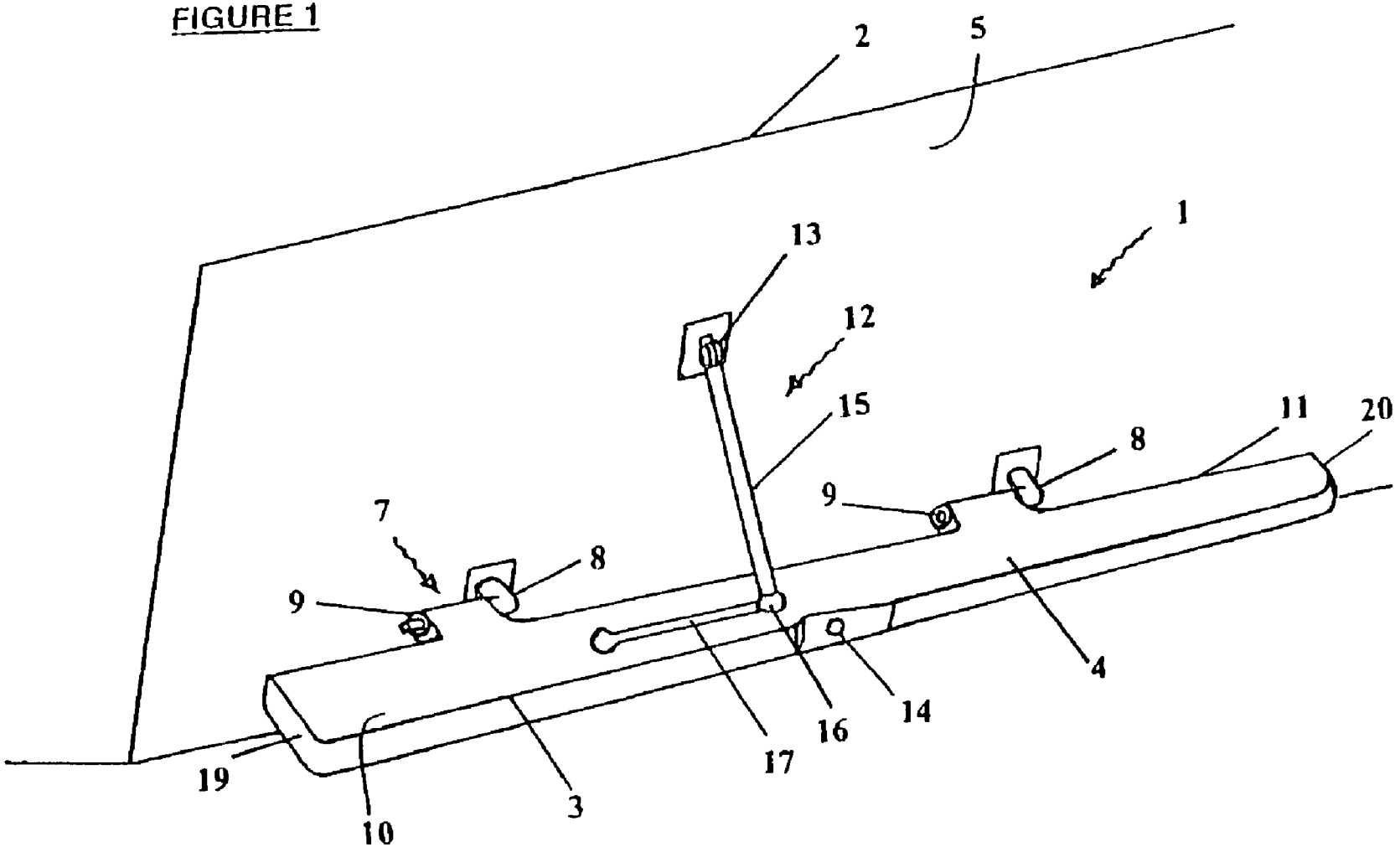
FIG. 1 is a perspective view of the stabilising apparatus in accordance with one preferred embodiment of the present invention.
Figure 2:
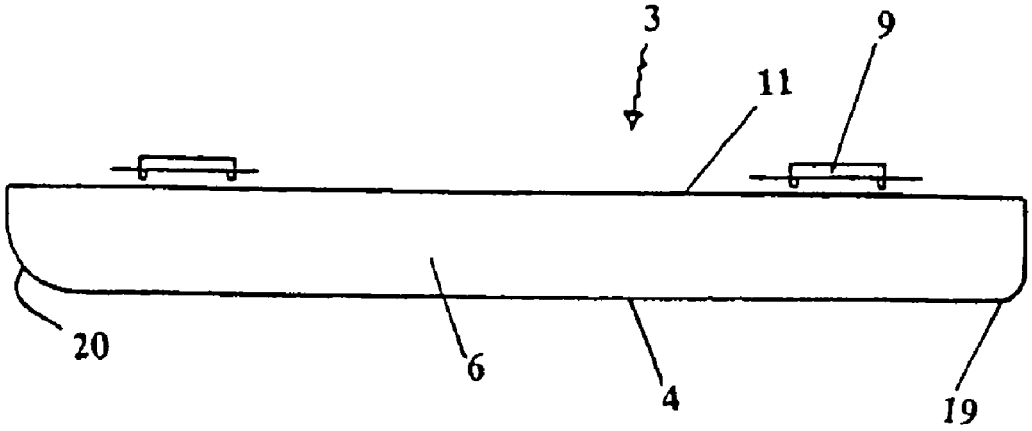
FIG. 2 is a bottom plan view of the body of the stabilising apparatus in accordance with one preferred embodiment of the present invention.
Figure 3:
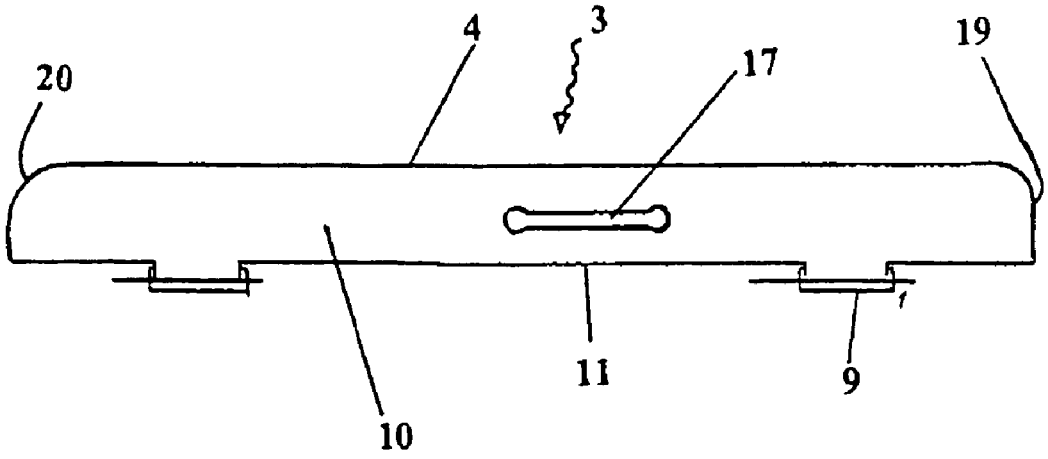
FIG. 3 is a top plan view of the body of the stabilising apparatus in accordance with one preferred embodiment of the present invention.
Figure 4:
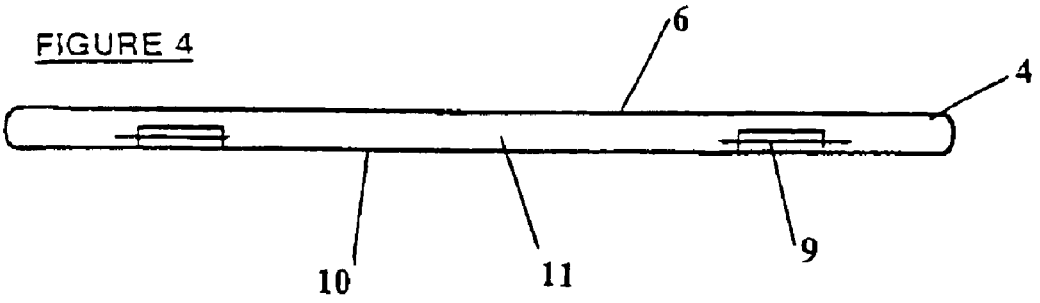
FIG. 4 is a side view of the body of the stabilising apparatus in accordance with one preferred embodiment of the present invention.
Figure 5:
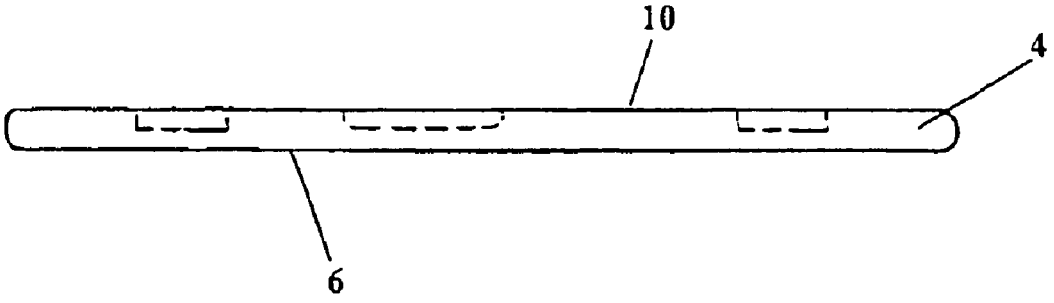
FIG. 5 is a side view of the body of the stabilising apparatus in accordance with one preferred embodiment of the present invention.

With reference to the diagrams by way of example only there is provided stabilising apparatus (generally indicated by arrow 1) for use in stabilising stationary, water borne objects (2).

The stabilizing apparatus (1) includes a body (3). The body (3) may include one or more stabilizing pods (4) having a longitudinal axis and being substantially rectangular in cross-section in a plane transverse to the longitudinal axis of the at least one stabilizing pod (4), as shown in FIGS. 7*a*-7*c*.

The body (3) is attachable to a portion of the side(s) (5) of the object (2). The point of attachment is typically at a position equating to the chine line or a boat, or equating to the plane of the water/surface.

FIGS. 1 through 6 and FIG. 8 show one preferred embodiment of the present invention where the body (3) comprises a single stabilising pod (4). FIGS. 7*a–c* refer to another embodiment in which the body (3) includes more than 1 stabilising pod (4).

Figure 7A:
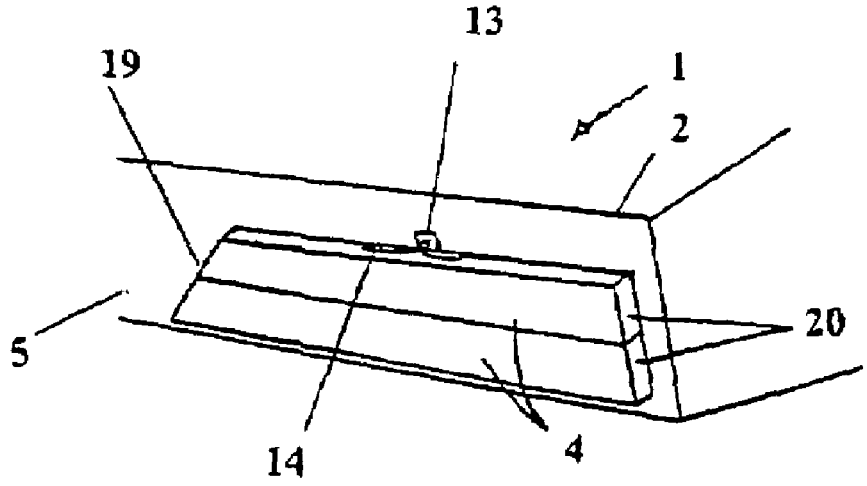
FIGS. 7*a–c* are perspective views of the stabilising apparatus in a range of positions from a non-use storage position to a fully extended operating position in accordance with another embodiment of the present invention.
Figure 7B:
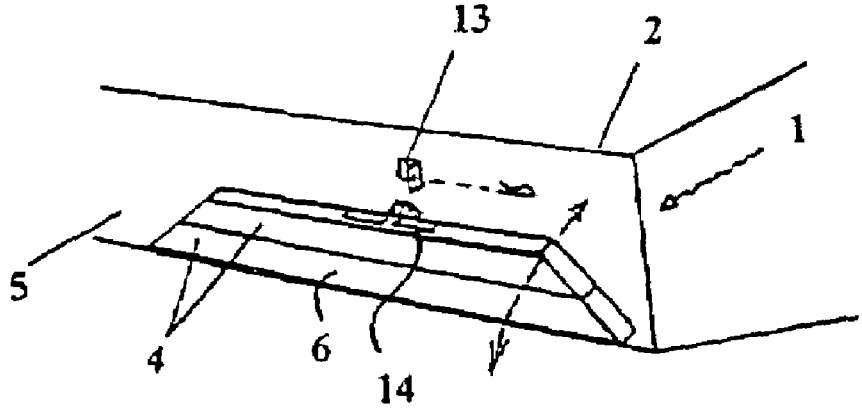
Figure 7C:
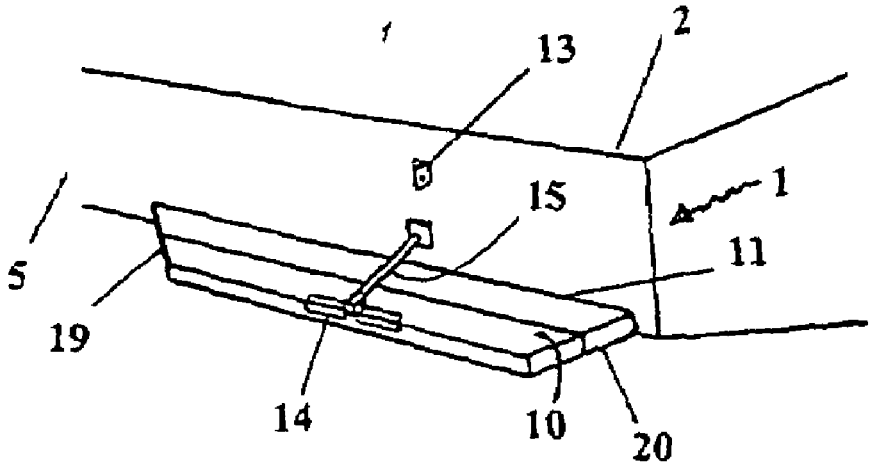

As illustrated in FIGS. 7*a–c,* the body (3) of the stabilising apparatus (1) is capable of pivoting through at least 90° between a position substantially aligned with, and in a substantially parallel arrangement to, the linear axis of the object (2) (as shown in FIG. 7*a*) and an extended operating position where the body (3) is substantially perpendicular to the linear axis of the object (2) (as shown in FIG. 7*c*). When the body (3) is in the extended operating position (FIG. 7*c*) the lower surface (6) of the body (3) is substantially in contact with and/or partially immersed in the water when the object (2) is at rest on a body of water.

To facilitate pivoting of the body (3) between the non-operating and operating positions, the body (3) is pivotably attached (at (7)) to the object (2). Accordingly, hinging apparatus is attached to the side (5) of the object (2). The hinging apparatus includes any number of either or both appropriately configured hinge eyes and hinge pins (8).

Similarly, the body (3) of the stabilizing apparatus (1) includes complementarily configured hinge eyes (9) and/or hinge pins (8). The hinge eyes (9) and/or hinge pins (8) may be attached to or integral with the body (3) and may be located on the upper (10), lower (6) or inner side (11) surface of the body (3). In the embodiment shown in FIG. 1, a fore portion (19) of the body (3) includes a hinge eye (9) which is slid rearward in a removably mounted engagement onto a forward extending hinge pin (8) mounted to the external surface of the side (5) of the object (2).

The arrangement of the hinging system distances the body (3) of the stabilising apparatus (1) from the side (5) of the object (2), by a preferred distance. For example, in the embodiment illustrated in FIGS. 1 to 6 the stabilising apparatus is designed to be used with a small vessel, such as an aluminium dinghy in a size range of eight foot to fourteen and a half feet long. In that embodiment, the body (3) may be distanced from the side (5) of the object (2) by approximately 100 mm when the stabilising apparatus (1) is in its extended operating position (although the distance may be greater depending upon the overall size and dimensions of the object (2)).

The stabilising apparatus (1) also includes latching apparatus (generally indicated by arrow 12). The latching apparatus (12) is capable of maintaining the body (3) in either or both an extended operating position and a non-use, storage position. The latching apparatus (12) includes at least a clasping apparatus (13) attached to the side (5) of the object (2). The body (3) may also include a complimentary configured clasp receiving portion (14) to engage with the clasp/latch (13) when the body (3) is in the non-use storage position. In other embodiments, the clasp/latch receiving portion (14) may be attached to the object (2) with the clasp/latch (13) attached to the body (3).

In addition, the latching apparatus (12) includes a stabilising arm or outrigger arm (15) that operates to brace the body (3) in the extended operating position when required.

The outrigger arm (15) may be attached to either a portion of the latch whether on the object (2) or the body (3). Accordingly, depending on its point of attachment the outer distal end (which may also be a free, unattached end (16)) of the outrigger arm (15) will then cooperatively engage with a portion of the object (2) or body (3) in a substantially bracing position when required.

As shown in the embodiment of FIG. 1, the outrigger arm (15) is connected to the side (5) of a vessel/object (2). When bracing the stabilising apparatus, the arm engages and is held in place on the upper surface (10) of the body (3) by means of a complimentary configured channel (17) into which the outer distal end (16) of the outrigger arm (15) is retained. This retention may be achieved by any suitable means, including a push-fit, bayonet-type operation, screw thread and so forth.

Figure 6:
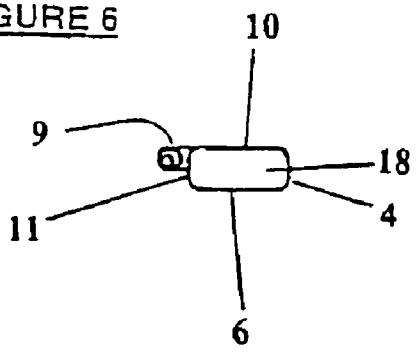
FIG. 6 is an end view of the body of the stabilising apparatus in accordance with one preferred embodiment of the present invention.

The dimensions of the body (3) are determined by the size of the vessel to which it will be attached, the surface area of the (3) body, the volume of water it is required to displace, the distance it is preferably hinged from the hull of the vessel and the volume of air contained in one or more cavities (18) as shown in FIG. 6. There may be a single cavity extending the full interior of the body, or several independent cavities may be desired. The use of foamed plastics material in the manufacture of the body may means fewer or smaller cavities are required.

In the embodiment illustrated in FIGS. 1 through 6 inclusive, the stabilising apparatus (1) is configured for use with small to medium sized vessels, such as aluminium vessels/dinghies and/or sailboats in a size range of 8 ft up to 14 ft 6". Accordingly, for vessels of the above mentioned lengths, the body (3) may be 1.5 m long, by up to 350 mm wide and may be outrigged from the side of the vessel hull by 100 mm.

Although these dimensions may vary between embodiments.

In FIGS. 7*a–c* inclusive, the body (3) may be made up of more than one stabilising pod (4). In this embodiment, two or more stabilising pods (4) form the body (3). The individual stabilising pods (4) may be directly joined together, or may be fixedly attached but spaced apart from each other (not shown).

Figure 8:
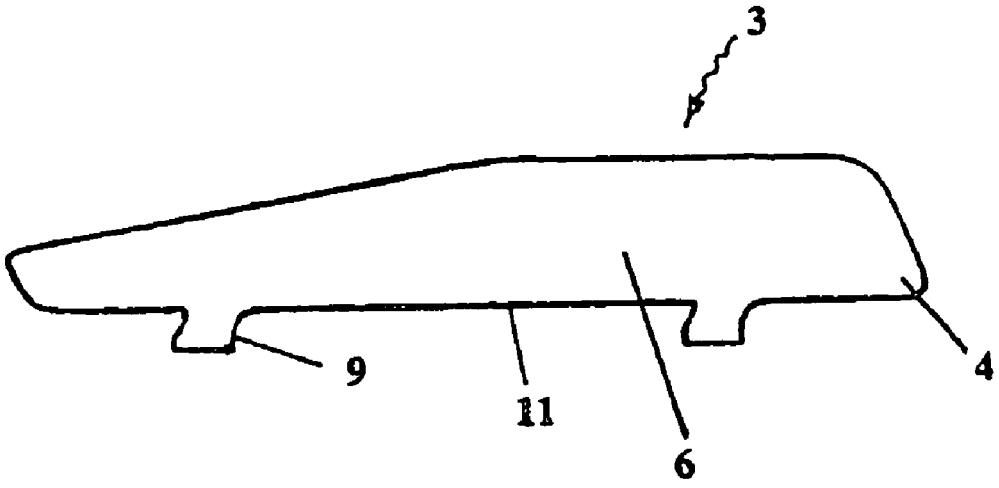
FIG. 8 is a bottom plan view of the body of the stabilising apparatus in accordance with another preferred embodiment of the present invention.

The overall configuration of the stabilizing pods (4) of the body (3) may also vary. For example, as shown in figures in 7 the leading edge may be substantially angled or curved. In the embodiment illustrated in FIG. 1, the body (3) includes the fore portion (19) and an aft portion having a trailing edge (20). in which the trailing edge (20) is substantially curved or tapered. FIG. 8 illustrates yet another alternative shape, where both ends are tapered or substantially angled, with the tapered end having a width of approximately 100 mm and the opposite end having a width of approximately 250 mm.

As can also be appreciated, the inner side (11) of the body (3) may either be substantially straight, or may also be curved to complement the shape of the object (2) with which it is used. The body (3) may also be substantially concave with respect to its upper surface (10) to further facilitate alignment of the body (3) against the side (5) of the object (2) when the stabilising apparatus (1) is in its non-use storage position.

The stabilising apparatus (1) and its components thereof are preferably made of thermoplastics materials, although other suitable materials such as fibreglass, stainless steel, aluminium, marine ply with resin coatings and so forth may be used.

Aspects of the present invention have been described by way of example only and it should be appreciated that modifications and additions may be made thereto without departing from the scope thereof, as defined in the appended claims.

The invention claimed is:

1. Stabilizing apparatus for use in stabilizing a water borne object floating on a body of water, with the water borne object having an external hinge pin mounted to at least one external side wall of the water borne object and configured such that the hinge pin extends forward, said stabilizing apparatus comprising:

a) a body, said body including:

b) at least one stabilizing pod having a longitudinal axis and including a hinging apparatus, said at least one stabilizing pod being substantially rectangular in cross-section in a plane transverse to the longitudinal axis of the at least one stabilizing pod, said at least one stabilizing pod being adapted to be readily attachable to the water borne object via cooperation with the hinging apparatus;

c) the hinging apparatus being removably mounted to the at least one external side wall of the object substantially towards the stern or rear end of the object and in the region of either or both the chine line and the plane of the water line when said object is in the water, wherein the hinging apparatus includes:

cl) a hinge eye which is slid rearward onto the forwardly extending external hinge pin on the side wall in a removably mounted engagement;

d) said at least one stabilizing pod adapted to co-operate with the hinging apparatus to pivotally hinge the stabilizing pod between a retracted, non-use, storage position against a side of the object, and an extended, operating position effecting contact between substantially an entire lower surface of the at least one stabilizing pod and the surface of the water; and e) latching apparatus, said latching apparatus including a bracing portion adapted to maintain the body in the non-use, storage position relative to the external side wall of the object to which the body is attached, and said latching apparatus, when released, further enabling the body to freely pivot towards the extended operating position wherein the bracing portion of the latching apparatus is further adapted to engage with the at least one stabilizing pod to maintain the body in the extended operating position; and wherein the at least one stabilizing pod is adapted to be removably attached to the side of the water borne object to effect use of the at least one stabilizing pod as a flotation device independent of the object.

2. Stabilizing apparatus as claimed in claim 1 wherein the body of the stabilizing apparatus including two or more stabilizing pods includes connecting means to connect the stabilizing pods directly to each other in either or both series and side-by-side.

3. Stabilizing apparatus as claimed in claim 1 wherein the body of the stabilizing apparatus is configured to be substantially elongate.

4. Stabilizing apparatus as claimed in claim 1 wherein the lower surface of each at least one stabilizing pod is able to effect optimum contact with the surface of the water when in the extended operating position by being adapted to be substantially flattened along the length of the lower surface.

5. Stabilizing apparatus as claimed in claim 4 wherein the substantially flattened configuration of the lower surface area of the at least one stabilizing pod in contact with the water effects a dampening and deflecting action on wave motion that would normally cause a stationary water borne object to rock.

6. Stabilizing apparatus as claimed in claim 4 wherein the at least one stabilizing pod is also configured to include at least one internal cavity for containing a calculated volume of air.

7. Stabilizing apparatus as claimed in claim 6 wherein the at least one internal cavity is extendable for the full length and internal width of the at least one stabilizer pod of the body.

8. Stabilizing apparatus as claimed in claim 7 wherein the internal cavities are inherent in the material from which the at least one stabilizing pod is manufactured.

9. Stabilizing apparatus as claimed in claim 6 wherein the at least one internal cavity of the at least one stabilizing pod contains air which contributes to either or both flotation and stabilization characteristics of the stabilizing apparatus.

10. Stabilizing apparatus as claimed in claim 1 wherein the body of the stabilizing apparatus is adapted to co-operate with hinging means attached to the side of the object via the inclusion of complementarily configured portions of the hinging means attached to or integral with the body, enabling operation of the body between extended and non-use positions.

11. Stabilizing apparatus as claimed in claim 10 wherein the hinging means enables the body of the stabilizing apparatus to pivot through an arc of up to or more than about 900°.

12. Stabilizing apparatus as claimed in claim 10 wherein the body of the stabilizing apparatus, when pivoted to a non-use storage position, is aligned against the side of the water borne object in a substantially parallel arrangement to the longitudinal axis of the object.

13. Stabilizing apparatus as claimed in claim 10 wherein the body of the stabilizing apparatus, when pivoted to an extended position, is in a substantially perpendicular arrangement relative to a longitudinal axis of the object, such that the stabilizing apparatus is laterally disposed relative to the side of the object.

14. Stabilizing apparatus as claimed in claim 13 wherein the body of the stabilizing apparatus in the extended operating position is spaced apart from the side of the object.

15. Stabilizing apparatus as claimed in claim 14 wherein the stabilizing apparatus is attached to at least one side of the water borne object, and is displaced towards the stem or rear of the object.

16. Stabilizing apparatus as claimed in claim 1 wherein the latching apparatus is released to allow the body of the stabilizing apparatus to pivot downward, including via the effects of gravity, to the extended position on the surface of the water.

17. Stabilizing apparatus as claimed in claim 1 wherein the latching apparatus includes at least one bracing arm, as a bracing portion, in the form of an outrigger arm for bracing the body of the stabilizing apparatus in the extended operating position.

18. Stabilizing apparatus as claimed in claim 17 wherein the outrigger arm is adjustable in length to effect secured bracing of the body in the extended operating position to be configured in an extended braced position.

19. Stabilizing apparatus as claimed in claim 17 wherein the outrigger arm is adapted to engage, at a distal end of the outrigger arm, to either or both the side of the object and to the body of the stabilizing apparatus, respectively, via clasping apparatus to effect the outrigger arm in a locked bracing position during use.

20. Stabilizing apparatus as claimed in claim 19 wherein the latching system includes a swivel system to enable the outrigger arm to be reoriented to a bracing alignment from a stored alignment.

21. Stabilizing apparatus as claimed in claim 20 wherein the outrigger arm is maintained in a complementary configured receptacle portion on or in the body in a stored alignment when the stabilizing apparatus is not in use.

22. Stabilizing apparatus as claimed in claim 1 wherein the stabilizing apparatus is used to stabilize any aquatic vessels including aluminum boats, small sailboats, small aquatic sporting equipment, floating pontoons and/or docks and launches that have a tendency to rock vigorously when at rest on water due to wind and water movements.

23. Stabilizing apparatus as claimed in claim 22 wherein, when the stabilizing apparatus is used in conjunction with aluminum vessels from 8 foot up to 14.5 foot in length, the length of the body is approximately 1.5 m long and has a width of approximately 350 mm, or any configuration that may be required to stabilize aquatic vessels of proportions greater than 8 foot up to 14.5 foot.

24. A method of manufacturing stabilizing apparatus for use in stabilizing a water borne object floating on a body of water, with the water borne object having an external hinge pin mounted to at least one external side wall of the water borne object and configured such that the hinge pin extends forward, said stabilizing apparatus including a body having at least one stabilizing pod having a longitudinal axis and including a hinging apparatus, said at least one stabilizing pod being substantially rectangular in cross-section in a plane transverse to the longitudinal axis of the at least one stabilizing pod, said at least one stabilizing pod being adapted to be readily attachable to a water borne object via cooperation with the hinging apparatus removably mounted to the at least one external side wall of the object substantially towards the stern or rear end of the object and in the region of either or both the chine line and the plane of the water line when said object is in the water, and said at least one stabilizing pod adapted to cooperate with the hinging apparatus to pivotally hinge the at least one the stabilizing pod between a retracted, non-use, storage position against a side of the object and an extended, operating position effecting contact between substantially the entire lower surface of the stabilizing pod and the surface of the water, said stabilizing apparatus also including a latching apparatus, said latching apparatus including a bracing portion adapted to maintain the body in the non-use, storage position relative to the external side wall of the object to which the body is attached, and said latching apparatus, when released, further enabling the body to freely pivot towards the extended operating position wherein the bracing portion of the latching apparatus is further adapted to engage with the stabilizing pod to maintain the body in the extended operating position, and said method including the steps of:

a) producing the body to include at least one substantially elongate stabilizing pod being substantially rectangular in cross-section in a plane transverse to the longitudinal axis of the at least one stabilizing pod, said at least one stabilizing pod including at least one internal cavity for containing a calculated volume of air;

b) attaching to, or including integral to the body, first hinging means including a hinge eye which is slid rearward onto the forwardly extending hinge pin on the side wall in a removably mounted engagement complementary with second hinging means including the external hinge pin attached to the object and mounted to at least one external side wall of the water borne object and configured such that the hinge pin extends forward, to enable the body to pivot between a non-use, storage position and an extended, operating position, relative to the object to which the body is attached; and c) providing latching apparatus for maintaining the body in either or both the extended operating position or the non-use storage position;

wherein at least one stabilizing pod of the stabilizing apparatus is adapted to be removably attached to the side of the water borne object in the region of either or both the chine and the plane of the waterline of the object when in use to effect use of the at least one stabilizing pod as a flotation device independent of the object.

25. A method of manufacturing the stabilizing apparatus as claimed in claim 24 wherein the stabilizing apparatus is configured for use as either or both a means of re-entering the vessel or object in the event that a person has fallen overboard or off the vessel or object, as well as a detachable emergency lifesaver/flotation device in the event of the vessel and/or object capsizing.

26. A method of stabilizing a stationary water borne object floating on a body of water using a stabilizing apparatus, with the water borne object having an external hinge pin mounted to at least one external side wall of the water borne object and configured such that the hinge pin extends forward, said stabilizing apparatus including a body, said body including at least one stabilizing pod having a longitudinal axis and including a hinging apparatus, said at least one stabilizing pod being substantially rectangular in cross-section in a plane transverse to the longitudinal axis of the at least one stabilizing pod, said at least one stabilizing pod being adapted to be readily attachable to a water borne object via cooperation with the hinging apparatus removably mounted to the at least one external side wall of the object substantially towards the stern or rear end of the object and in the region of either or both the chine line and the plane of the water line when said object is in the water, and said at least one stabilizing pod adapted to cooperate with the hinging apparatus to pivotally hinge the at least one stabilizing pod between a retracted, non-use, storage position against the side of the object and an extended, operating position effecting contact between substantially an entire lower surface of the at least one stabilizing pod and the surface of the water, said stabilizing apparatus also including a latching apparatus, said latching apparatus including a bracing portion adapted to maintain the body in the non-use, storage position relative to the external side wall of the object to which the body is attached, and said latching apparatus, when released, further enabling the body to freely pivot towards the extended operating position wherein the bracing portion of the latching apparatus is further adapted to engage with the at least one stabilizing pod to maintain the body in the extended operating position, and said method including the steps of:

a) using at least one substantially elongate stabilizing pod, being substantially rectangular in cross-section in a plane transverse to the longitudinal axis of the at least one stabilizing pod, as the at least one stabilizing pod having dimensions relative to the object to effect maximum contact of the lower surface of the at least one stabilizing pod with the surface of the water when in use, and said stabilizing pod including at least one internal cavity to contain a calculated volume of air to effect desired flotation and stabilization of the object;

b) providing first hinging means including a hinge eve which is slid rearward onto the forwardly extending hinge pin on the side wall in a removably mounted engagement to engage with complementarily configured second hinging means including the external hinge pin attached to the object and mounted to at least one external side wall of the water borne object and configured such that the hinge pin extends forward, to enable the at least one stabilizing pod of the body to pivot between a non-use, storage position and an extended, operating position, relative to the object to which the body is attached;

c) attaching the stabilizing apparatus to the object along the side and towards the rear of the object equating to the region of either or both the chine line and the plane of the water line when the object is floating in a body of water;

d) attaching the stabilizing apparatus to the object to effect the required distance the stabilizing apparatus extends from the object when in the extended operating position; and e) latching the stabilizing apparatus in its extended operating position and in contact with the water;

wherein the stabilizing apparatus effects a dampening and deflecting action on wave motion that would normally cause a stationary water borne object to rock.

* * * * *